US009968983B2

(12) United States Patent
Dunwoody

(10) Patent No.: US 9,968,983 B2
(45) Date of Patent: May 15, 2018

(54) METHOD FOR FORMING A METAL CLOSURE

(75) Inventor: Paul Robert Dunwoody, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 1050 days.

(21) Appl. No.: 14/347,696

(22) PCT Filed: Apr. 16, 2012

(86) PCT No.: PCT/EP2012/056891
§ 371 (c)(1),
(2), (4) Date: Feb. 27, 2015

(87) PCT Pub. No.: WO2012/143322
PCT Pub. Date: Oct. 26, 2012

(65) Prior Publication Data

US 2015/0165509 A1 Jun. 18, 2015

(30) Foreign Application Priority Data

Apr. 20, 2011 (EP) ..... 11163300
Apr. 20, 2011 (EP) ..... 11163301
Apr. 20, 2011 (GB) ..... 1106678.4

(51) Int. Cl.
*B21D 51/44* (2006.01)
*B21D 19/12* (2006.01)

(52) U.S. Cl.
CPC ..... *B21D 51/44* (2013.01); *B21D 19/12* (2013.01)

(58) Field of Classification Search
CPC ..... B21D 51/44; B21D 51/446; B21D 19/12; B21D 51/50; B21D 51/443
USPC ..... 413/8, 24
See application file for complete search history.

(56) References Cited

U.S. PATENT DOCUMENTS

| | | | | |
|---|---|---|---|---|
| 2,089,518 A | | 8/1937 | Williams | |
| 2,275,220 A | * | 3/1942 | Enkur | B21D 51/44 413/24 |
| 3,446,381 A | | 5/1969 | Podesta et al. | |
| 3,641,959 A | * | 2/1972 | Hurst | B21D 51/44 29/430 |
| 2007/0113985 A1 | | 5/2007 | Gysi et al. | |
| 2010/0003109 A1 | * | 1/2010 | Ramsey | B21D 51/44 413/8 |
| 2010/0183406 A1 | | 7/2010 | Gysi et al. | |

FOREIGN PATENT DOCUMENTS

| | | |
|---|---|---|
| EP | 0921878 | 6/1999 |
| EP | 0 980 726 A2 | 2/2000 |
| EP | 2208554 | 7/2010 |
| GB | 1 520 716 | 8/1978 |

(Continued)

OTHER PUBLICATIONS

IP Office of Singapore Application No. 11201401014R: Search Report and Written Opinion dated Oct. 6, 2014, 23 pages.

*Primary Examiner* — Debra Sullivan
(74) *Attorney, Agent, or Firm* — Baker & Hostetler LLP

(57) ABSTRACT

A modular method of forming a two part metal closure comprises a lug forming module for forming lugs 3 on a ring 1, a panel curl module, and an assembly module which fixes the panel inside the ring while allowing axial movement of the panel for opening.

12 Claims, 8 Drawing Sheets

(56) References Cited

FOREIGN PATENT DOCUMENTS

| | | |
|---|---|---|
| GB | 2149388 | 6/1985 |
| WO | WO 97/49510 | 12/1997 |
| WO | WO 01/38207 | 5/2001 |
| WO | WO 2006/097005 | 9/2006 |
| WO | WO 2008/053014 | 5/2008 |
| WO | WO 2009/115377 | 9/2009 |
| WO | WO 2010/136414 A1 | 12/2010 |

* cited by examiner

METHOD FOR FORMING A METAL CLOSURE

CROSS-REFERENCE TO RELATED APPLICATIONS

This application is the National Stage of International Patent Application No. PCT/EP2012/056891 filed Apr. 16, 2012, which claims the benefit of European Patent Application No. 11163300.4 filed Apr. 20, 2011, United Kingdom Patent Application No. 1106678.4 filed Apr. 20, 2011, European Patent Application No. 11163301.2 filed Apr. 20, 2011, and United Kingdom Patent Application No. 1116784.8 filed Sep. 29, 2011, the disclosures of which are incorporated herein by reference in their entireties.

TECHNICAL FIELD

This invention relates to a method and apparatus for forming curls and lugs on a metal closure. In particular, but not exclusively, it relates to the forming of curls and lugs on a metal ring and panel which are intended to form part of a two part metal closure of the type described in WO 2008/053014 (CROWN PACKAGING TECHNOLOGY, INC) and WO 2009/115377 (CROWN PACKAGING TECHNOLOGY, INC). The method of this invention addresses, in particular, the handling of metal rings during the forming of the curls and lugs on such rings and the forming of a curl on the panel part and the reduction of the diameter of the panel.

This invention also relates to a method and apparatus for assembly of the metal ring and panel of the two part metal closure. The method of this aspect of the invention includes methods of placing the panel inside the ring and retaining the panel part movably between upper and lower ends of the ring.

BACKGROUND ART

WO 2008/053014 describes several possible sequences of manufacturing steps to produce a two-part metal closure. In the manufacture of the two part closure of FIG. 2 of WO 2009/115377, it is desirable to form a profile comprising an inward curl and lugs at the lower end of a thin sheet-metal ring, and to inwardly curl the upper end of the ring, to retain a panel part moveably between the upper and lower ends of the ring. It is also desirable to accurately curl and reduce the diameter of a panel part in as few manufacturing operations as possible.

Conventional methods of forming curls and lugs on metal closures are well known, and the method shown in GB 2149388 (ANCHOR HOCKING CORPORATION) is one example. Conventional methods are suitable for one-part closures having an end panel and sidewalls, wherein the apparatus is able to push against the end panel. This ability is important for loading the closure into the apparatus, for supporting it to avoid unwanted deformation, whilst forming loads are applied, and for unloading it from the apparatus after forming the lugs and curl. However, the ring of the present invention corresponds to that of a closure of the type described in WO 2009/115377 (CROWN PACKAGING TECHNOLOGY, INC) (which is in the same name as the current applicant), and which therefore has no end panel to push against.

EP 0921878 B (IMPRESS METAL PACKAGING GMBH) shows the use of a tool segment with an annular shoulder to push a cylinder segment into an arrangement of forming tools. The cylindrical wall of the cylinder segment is almost entirely inwardly formed and thus the formed cylinder segment is easy to remove when the tools are moved apart.

In contrast, to form the curl and lugs of a closure ring of the type described in WO 2009/115377 (CROWN PACKAGING TECHNOLOGY, INC), it is necessary to support the cylindrical wall during forming and the cylindrical wall of the formed ring also remains engaged in contact with the cylindrical pushing tool after forming.

SUMMARY OF INVENTION

This invention provides a method and apparatus for forming, in a first module, a metal closure ring, in which the ring is slid over a cylindrical pushing tool having a ledge against which one end of the ring seats, whilst the opposite end is pushed into a forming tool to form a profile comprising curl and lug portions.

The pushing tool is preferably sized to grip the ring sufficiently to ensure that the ring is removed from the forming tool after the profile has been formed.

The ring may already have a curl at the end to be formed into the profile. In WO 2008053014 a curl is formed as a "pre-curl" before the ring is cut from the closure blank to initially create the two parts of the closure. Such a pre-curl may be formed with a radius that is smaller than the radius of the curl in the profile.

The pushing tool may be provided with protrusions corresponding to the positions of the lugs to be formed. These protrusions are preferably shaped to form the upper sides of the lugs to an angle corresponding to the threads of the jar onto which the closure is to be applied. These protrusions are preferably positioned at a specific distance from the ledge to control the dimensions of the lugs within the ring.

The pushing tool may be provided with features to provide means of removing the ring from it once the profile has been formed. The embodiments of the invention provide means to remove the formed ring from the pushing tool.

In a first embodiment, the end of the pushing tool is divided into segments, and a plate is provided with cut-out portions corresponding to each segment, through which the pushing tool is moved. Thus the ring may be slid into position on the plate, the pushing tool may be moved to lift the ring, to slide the ring into position against the ledge and push it into the forming tool to form the profile, before the pushing tool is moved back through the plate to remove the ring from the pushing tool.

In a second embodiment the inner cylindrical portion of the pushing tool is separated from the outer ledge portion, so that the ledge can slide along the cylindrical portion to strip the ring off the pushing tool.

In a third embodiment, a pushing tool is provided with a cylindrical outer sleeve, into which the ring is placed, and a cylindrical inner part, which provides the ledge. Such a sleeve may be profiled to bend the edge of the ring slightly inwards if desired to assist subsequent forming of an inward curl at that edge. The two parts may be arranged to slide to assist loading and removal of the ring.

The lug-forming tool may comprise one or more parts. Preferably the lug-forming tool comprises one part having a profile corresponding to the shape of the curl and lug portions to be formed, and a separate cylindrical internal part to limit the inward movement of the lugs and accurately control the distance between opposing lugs.

This invention further provides a second module comprising a method (and corresponding apparatus) for simultaneously curling the edge and reducing the diameter of a panel part, by clamping the face of the panel part and pushing the wall of the panel part into a die having a first portion of the same diameter as the wall, connected to a second portion of a reduced diameter, and in turn connected to a third portion having a radius corresponding to the shape of the desired curl. The edge to be reduced in diameter and curled in this way is preferably provided with a "pre-curl" of a smaller radius than the final curl, since this helps the formation of a smooth curl without damage to coatings. Such a "pre-curl" may be created by pushing the edge of the wall of the panel part axially into contact with spinning rollers.

This invention comprises an assemble module which provides methods of placing the panel inside the ring. One preferred method is to convey the panel on a magnetic or vacuum conveyor with a belt having good grip under an angled chute containing rings. The lowermost ring in the chute is restrained in a position slightly above the belt using magnets or spring clips, and is pulled down over the panel as the panel is driven along the conveyor below. Another preferred method is to feed a panel and a ring into a pair of axially aligned pockets and to push either the ring over the panel or the panel into the ring.

The assembly module of the invention further provides a method of inwardly curling the upper end of the ring, to retain the panel part moveably between the upper and lower ends of the ring, by placing the assembled ring and panel into a holder and moving the ring axially into contact with spinning rollers. The holder comprises an outer sleeve to centralize and grip the lower end of the ring, and a separately moving ejector. Preferably, the panel is pushed against the inside of the ring, which helps push the ring firmly into the sleeve to prevent it slipping while the rollers form the curl. In one preferred embodiment, the outer sleeve is profiled to contact the underside of the ring and control the height of the curled ring. In another preferred embodiment, the outer sleeve only contacts the wall of the ring, and the ejector is positioned against the underside of the ring to control the height of the curled ring.

In a preferred arrangement of the holder a guiding annulus is connected to the outer sleeve. This guiding annulus helps to centralize the ring by contacting the lugs of the ring if it is off-centre and pushing it to a central position before the outer sleeve moves into contact with the ring.

DESCRIPTION OF EMBODIMENTS

Figure 1:
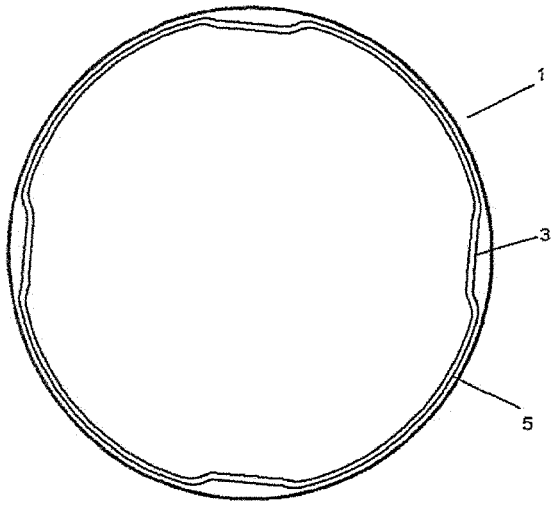
FIG. 1 is a plan view of a ring which has lugs.

FIG. 1 shows a closure ring 1, having four lugs 3 which are spaced at equal distances around the perimeter of the ring 1. Between the lugs 3, the perimeter is in the form of a curl 5. In the method of the invention, the closure comprises two parts, a ring such as that shown in FIG. 1 and a panel which is described hereinafter with reference to FIG. 6. The method of forming the two part closure of the invention requires first forming of a ring having lugs as shown in FIG. 1. This ring is also referred to as a "lugged ring".

Figure 2:
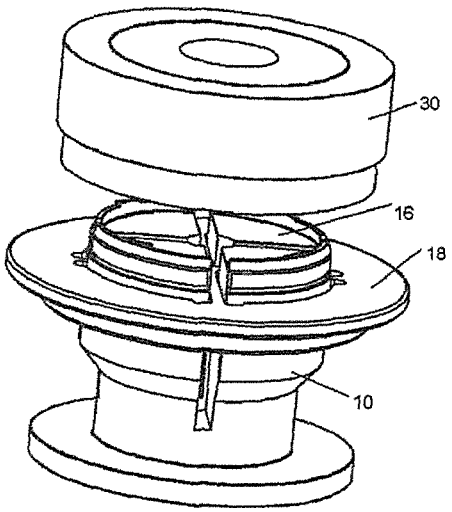
FIG. 2 is a perspective view of a lugging tool.
Figure 3:
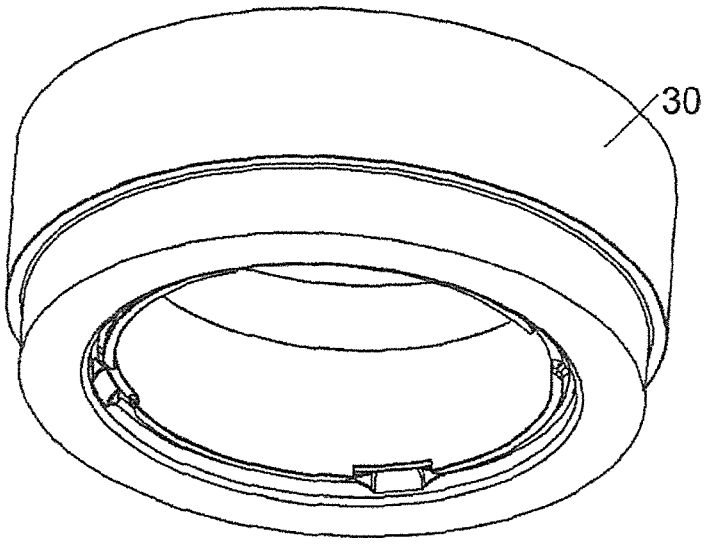
FIG. 3 is a further perspective view of a lugging tool and pusher.
Figure 3:
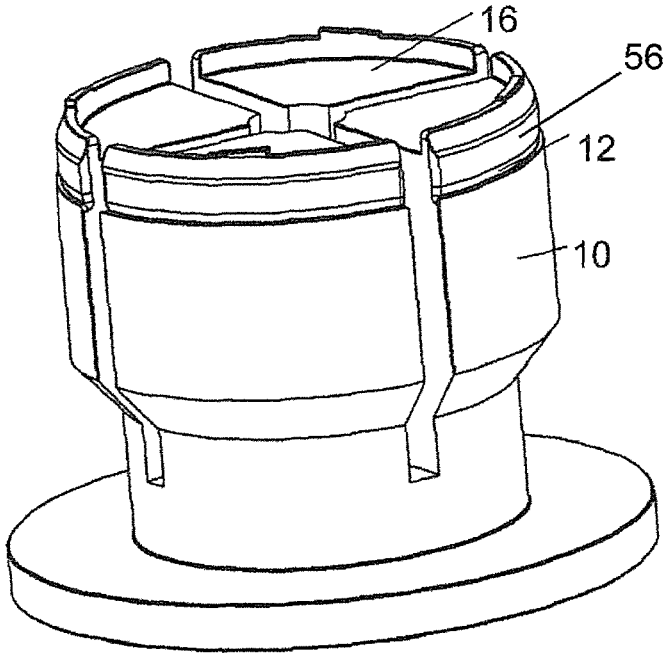

Forming of lugs on an unsupported ring of thin sheet metal is an essential part of the present invention. A tool for forming lugs is also referred to as a "lugger" or "lugging tool". FIG. 2 shows an upper isometric view of a lugging tool 30 above a pushing tool 10 (also referred to as a pusher). In FIG. 3, the lugging tool 30 is angled away from the plane of the paper to show positions of profiles for forming the lugs.

The pushing tool 10 has a ledge 12 on which, in use, a ring 1 can be seated. In this way, the ledge provides support for the ring while the lug forming tool 30 engages the opposite end of the ring for forming curl and lug portions of the ring. The pusher 10 carrying a ring 1 is generally moved towards the lug forming tool 30 although clearly the lugger could move towards the pusher or a combination of both movements could be used.

The pusher 10 is shown in the same angle perspective positions for both FIG. 2 and FIG. 3. The end of the pushing tool 10 of FIGS. 2 and 3 is divided into segments 16 and the pusher of FIG. 2 also includes a plate 18. The plate 18 is provided with cut-out portions corresponding to each segment 16, through which the pushing tool is moved. Thus, in use, the ring is positioned on the plate and the pushing tool lifts the ring and slides it against the ledge 12 (FIG. 3).

Figure 4A:
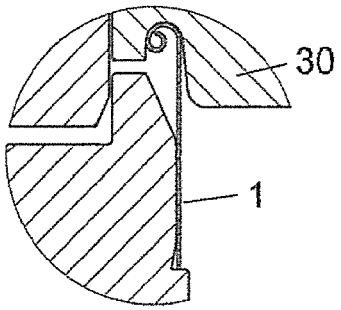
FIGS. 4*a* and 4*b* are side sections on the lugging tool at curl and lug positions of the ring respectively.
Figure 4B:
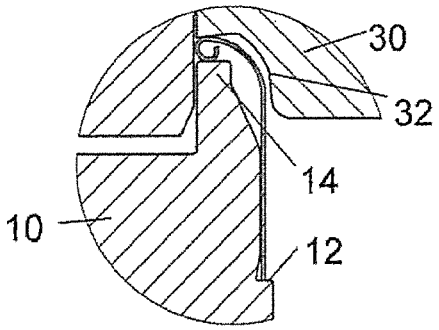

Further upward movement of the pushing tool pushes the ring 1 into the forming tool to form the lugged profile of the ring as shown in FIG. 4. In FIG. 4, the pusher includes protrusions 14 which correspond to the positions of the lugs which are to be formed on the ring. These protrusions 14 are shaped to form the upper sides of the lugs into an angle or angles which correspond to the threads of the jar onto which the closure is to be applied.

Finally, the pushing tool is moved back through the plate to remove the ring from the pushing tool.

Figure 5:
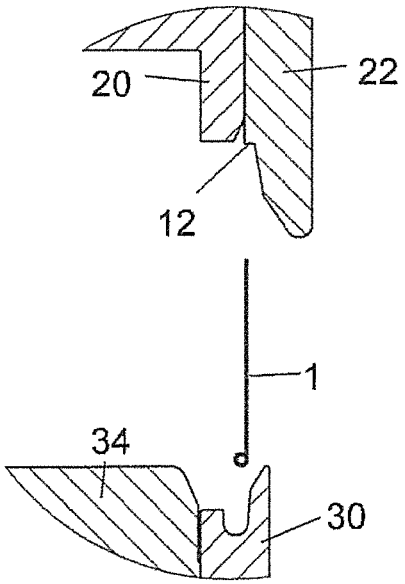
FIG. 5 is an inverted lugging tool.

FIG. 5 shows an enlarged side section of an inverted pusher in which the inner cylindrical portion 20 is separated from the outer portion 22 which includes the ledge 12. This configuration enables the outer portion 22 to slide relative to the inner portion so that the ledge strips the ring off the pushing tool.

Also in the inverted tool of FIG. 5, the lugging tool 30 at the bottom has a cylindrical inner part 34. Inner part 34 limits the inward movement of the lugs and controls accurately the distance between opposing lugs.

Figure 6A:
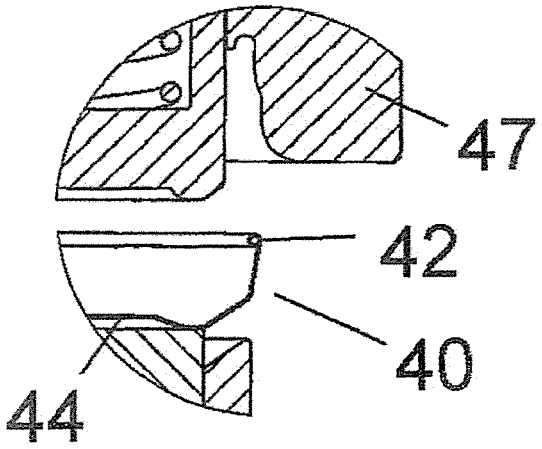
FIGS. 6*a*, 6*b* and 6*c* are side sections of panel die curl forming steps.
Figure 6B:
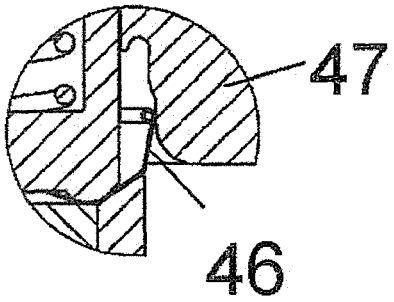
Figure 6C:
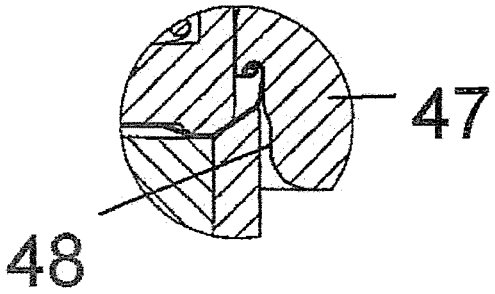

FIGS. 2 to 5 effectively comprise a lug forming module of the closure manufacture of the invention. A panel forming module is shown in FIG. 6. The panel forming module provides a method of simultaneously curling the edge 42 of a disc-shaped panel part 40, and reducing the diameter of the panel 40. The face 44 of the panel 40 is lifted and clamped against a sprung centre section of die 47, whilst the panel wall 46 is pushed into the die 47.

The die 47 has a profile wall 48 which reduces in diameter with the radially innermost part having a radius which corresponds to the desired shape of the curl at the edge 42 of the panel. The edge 42 is typically provided with a form of "pre-curl" which is shown in the drawings of FIG. 6. This pre-curl is of smaller radius than that of the final curl, as can be seen by the profile of the uppermost part of profiled die wall 48.

Figures 7, 7A:
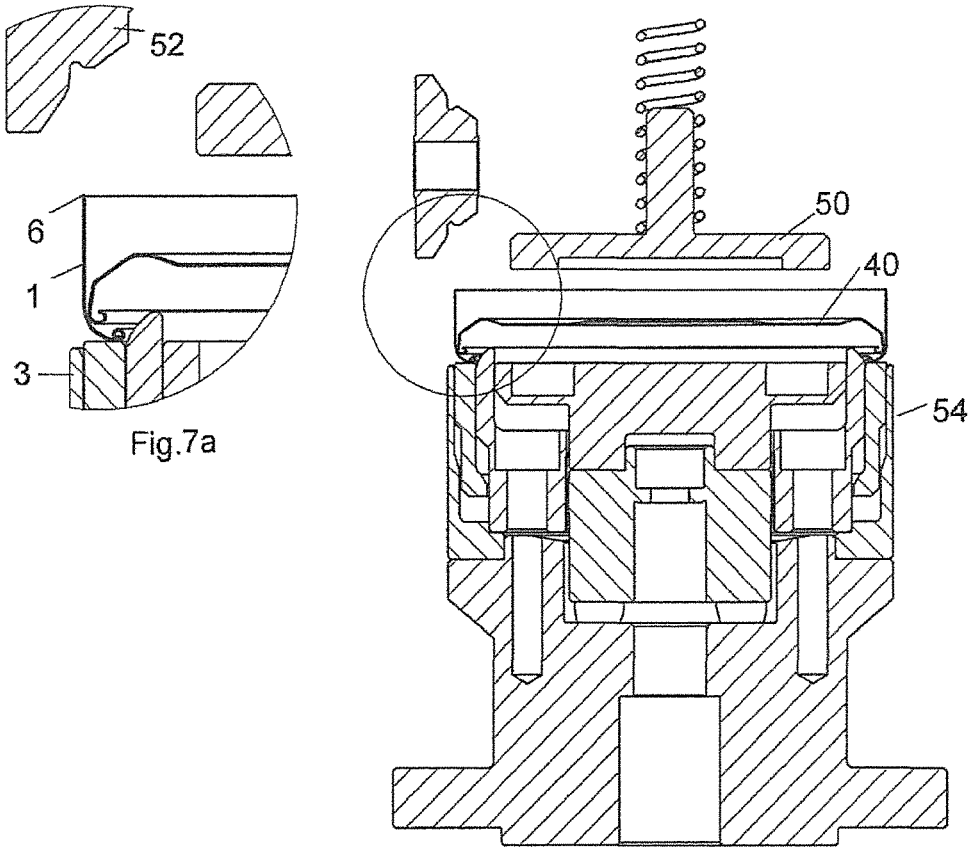
FIG. 7 is a section of tooling of an assembly module for forming a first operation curl on an upper edge of the ring.
FIG. 7*a* is an enlarged section of the roller at a lug position.
Figure 8:
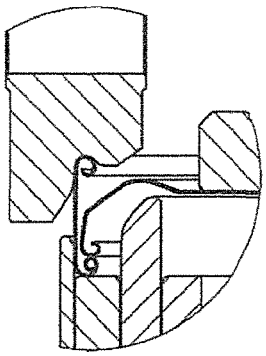
FIG. 8 is a section of tooling of the assembly module, for forming a second operation ring curl, in the closed position.
Figure 8A:
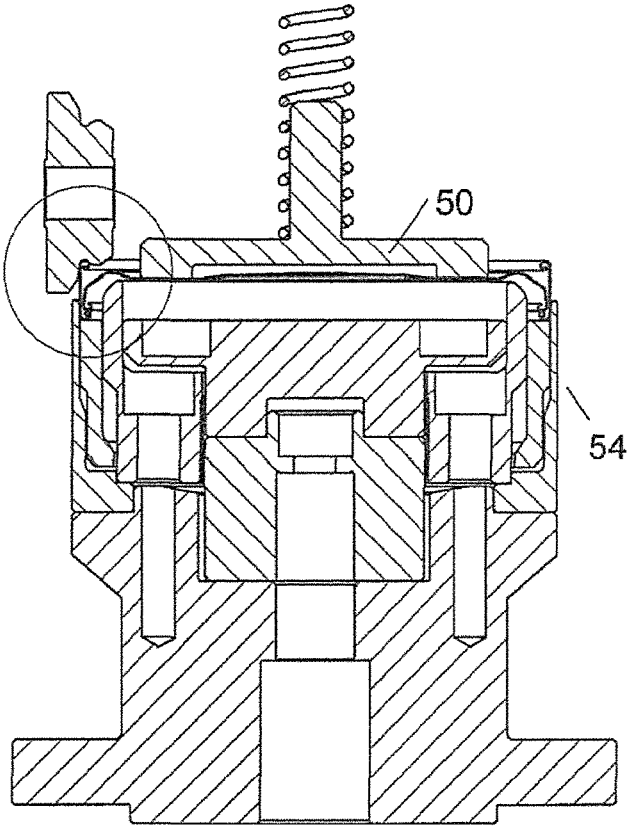
FIG. 8*a* is an enlarged section of the roller at a curl position.

The closure manufacture of the present invention provides a final "assembly" module in which rings from the ring forming module of FIGS. 2 to 5 are coupled with the panels from panel forming module of FIG. 6. The final module is shown in FIGS. 7 and 8 and initially involves placing a panel 40 inside a ring 1. The formation of the two part closure requires a curl to be formed at the upper end 6 of the ring. The inward curling of the upper end of the ring retains the panel 40 between upper and lower curls, whilst allowing movement of the panel between the curled ends.

The inward curl on the upper end is formed by pushing the panel 40 into the ring 1 with a pusher 50 and then placing the assembled ring and panel into a holder 54. The ring 1 is then moved axially into contact with spinning rollers 52 as shown in FIG. 7 to form the first operation curl. In FIG. 8, the ring undergoes a second curling operation in which the curl is tightened to its final form.

Once the panel is enclosed within the ring, it is free to move axially whilst forming a unitary closure.

The methods have been described above by way of example only and changes may be made without departing from the scope of the invention. For example, the upper end of the ring may be curled twice by the method described, and the rollers of the first curl have a smaller forming radius than the second curl. This allows the cut edge of the ring to be safely hidden, and the height of the panel within the ring to be well controlled during capping.

In an alternative method of forming the second curl, the upper end of the ring may be pushed into a die, but this method requires more axial force to be applied by the holder.

All the methods described may be carried out in any orientation, and appropriate handling and guiding features that have not been shown for clarity may be included.

REFERENCE SIGNS LIST

1 closure ring
3 lugs
5 curls
6 upper edge of ring
10 pushing tool (pusher)
12 ledge (on pusher)
14 protrusions (on pusher)
16 segments (on end of pusher)
18 plate
20 inner cylindrical portion
22 outer ledge portion (of reciprocating pusher)
30 lug forming tool
32 lug forming profile
34 cylindrical inner part ("stop")
40 panel part
42 panel edge
44 panel face
46 panel wall
47 die
48 profile wall of die
50 conveyor/pusher for panel
52 roller
54 holder
56 outer sleeve
58 ejector

The invention claimed is:

1. A method of forming a profile in a metal ring for use in a two part metal closure comprising the ring and an independently formed metal panel, the method comprising:

sliding the ring over a cylindrical pushing tool, the cylindrical pushing tool comprising a ledge and a plurality of protrusions, wherein a first end of the ring is seated against the ledge; and pushing a second end of the ring into a forming tool to form the profile comprising curl and lug portions, wherein the lug portion is formed by one of the plurality of protrusions.

2. A method according to claim 1, wherein the pushing tool removes the ring from the forming tool after the profile has been formed due to the pushing tool being sized to exert a sufficient grip on the ring.

3. A method according to claim 1, further comprising:

forming a pre-curl on said second end of the ring prior to the step of forming a profile comprising curl and lug portions.

4. A method according to claim 3, further comprising:

after forming the pre-curl on said second end of the ring, cutting the ring from a closure blank.

5. An assembly module configured to form a metal ring for use in a two part metal closure, the assembly module comprising:

a cylindrical pushing tool adapted to slidably receive the metal ring, the cylindrical pushing tool comprising:

a ledge adapted to seat against one end of the metal ring, and a plurality of protrusions; and a forming tool adapted to receive an opposite end of the metal ring to form a profile comprising curl and lug portions, wherein each of the plurality of protrusions is configured to form each lug portion.

6. An assembly module according to claim 5, wherein said plurality of protrusions are shaped to form the upper sides of the lugs at an angle relative to a plane of the ring and corresponding to threads of a jar onto which the closure is to be applied.

7. An assembly module according to claim 5, wherein an end of the pushing tool is divided into segments and further comprising a plate provided with cut-out portions corresponding to each segment and through which the pushing tool is moved, wherein the plate is adapted to slidably receive the ring into a position on the plate, and the pushing tool is further adapted to move to lift the ring, slide the ring into position against the ledge, and push the ring into the forming tool to form the profile, before the pushing tool is moved back through the plate to remove the ring from the pushing tool.

8. An assembly module according to claim 5, wherein the pushing tool includes an inner cylindrical portion separated from an outer portion on which said ledge is provided, wherein the pushing tool is adapted to strip the ring off the pushing tool by sliding along the cylindrical portion to strip the ring off the pushing tool.

9. An assembly module according to claim 5, further comprising:

a cylindrical outer sleeve adapted to receive the ring, and a cylindrical inner part which provides the ledge.

10. An assembly module according to claim 9, wherein said outer sleeve is adapted to bend the edge of the ring slightly inwards to assist subsequent forming of an inward curl at that edge.

11. An assembly module according to claim 9, said cylindrical outer sleeve and said cylindrical inner part being arranged to slide to assist loading and removal of the ring.

12. An assembly module according to claim 5, wherein forming tool comprises:

one part having a profile corresponding to a shape of the curl and lug portions to be formed, and a separate cylindrical internal part adapted to limit the inward movement of the lugs and accurately control the distance between opposing lugs.

* * * * *